United States Patent [19]

Robbins et al.

[11] 4,175,297

[45] Nov. 27, 1979

[54] INFLATABLE PILLOW SUPPORT

[76] Inventors: William E. Robbins, 4850 Sutton Ave.; Robert H. Richardson, 8361 Sylvan Dr., both of Melbourne, Fla. 32901

[21] Appl. No.: 875,124

[22] Filed: Feb. 3, 1978

[51] Int. Cl.[2] ..... D47C 7/74

[52] U.S. Cl. ..... 5/284; 5/447; 128/33; 297/DIG. 3; 297/180

[58] Field of Search ..... 297/284, 336, 453, DIG. 3; 5/349, 368, 369, 284, 347; 62/261; 165/46; 98/1; 126/204, 208; 128/33

[56] References Cited

U.S. PATENT DOCUMENTS

| | | | |
|---|---|---|---|
| 2,802,088 | 8/1957 | MacCracken et al. | 126/204 |
| 3,326,601 | 6/1967 | Vanderbilt | 5/369 |
| 3,738,702 | 6/1973 | Jacobs | 165/46 |
| 3,795,021 | 3/1974 | Moniot | 5/368 |

*Primary Examiner*—Casmir A. Nunberg

*Attorney, Agent, or Firm*—Richard D. Dixon

[57] ABSTRACT

The present invention relates to an alternating inflatable support for the human body. The invention includes a flexible pillow having a plurality of fluid impervious pockets therein which are substantially flat when deflated, but which support an adjacent section of the human body when inflated with a fluid under pressure. The pockets are interspersed and grouped into an operably coupled first set of pockets and an operably coupled second set of pockets. A pump is provided which includes at least one pumping chamber for receiving and expelling fluid under pressure. A solenoid is operably coupled to the pumping chambers for compressing and expanding the pumping chambers. A valve is operably coupled between the pump and the flexible pillow for alternately inflating and exhausting the fluid through the first set of pockets and the second set of pockets, thereby alternately supporting the interspersed sections of the body adjacent to the first set of the pockets and the second set of pockets.

15 Claims, 9 Drawing Figures

FIG. 1
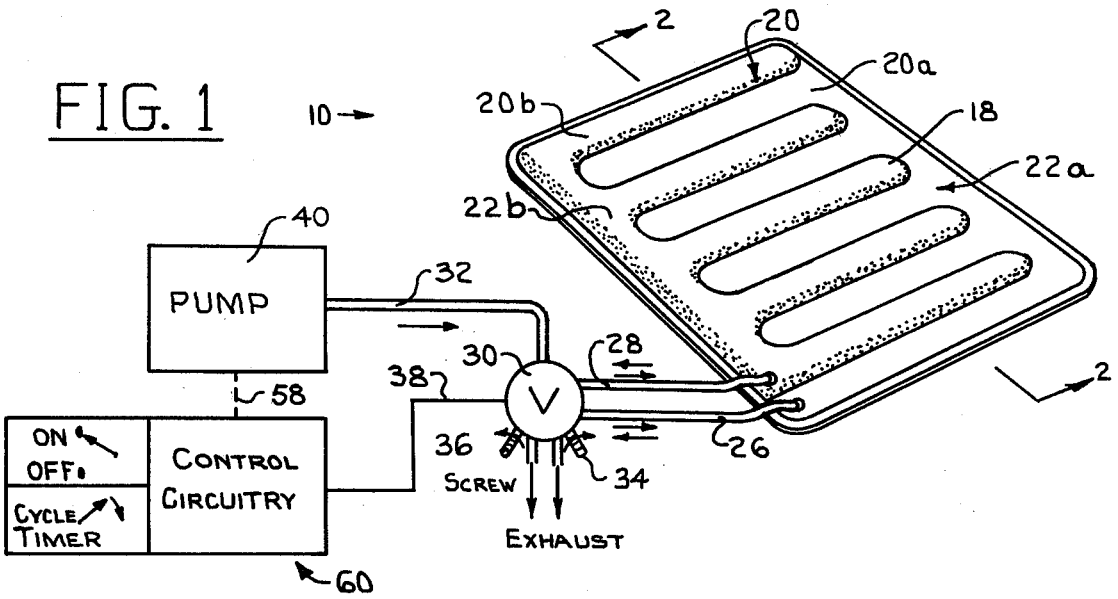
FIG. 2
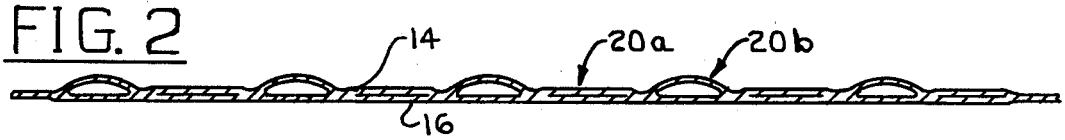
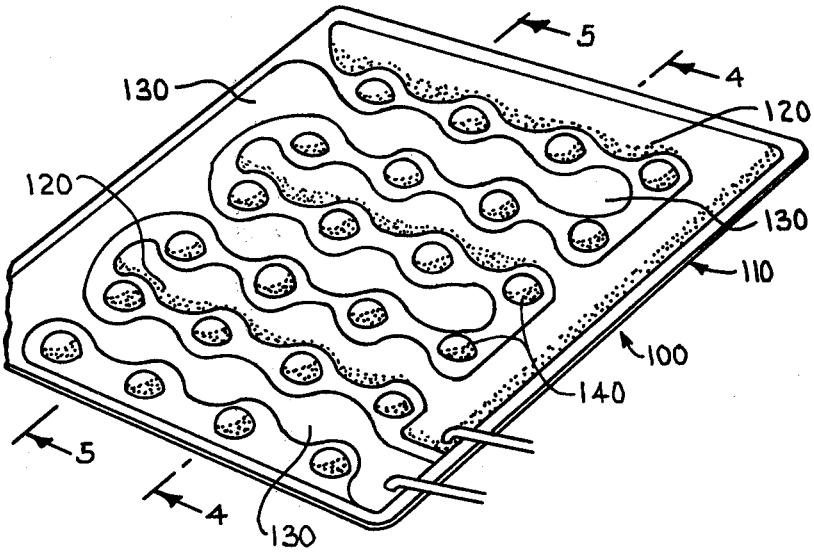
FIG. 3
FIG. 4
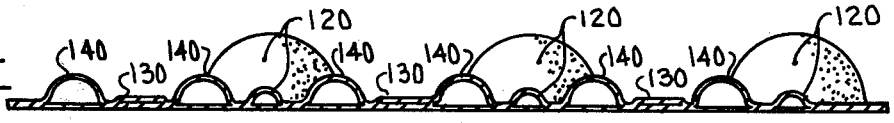
FIG. 5
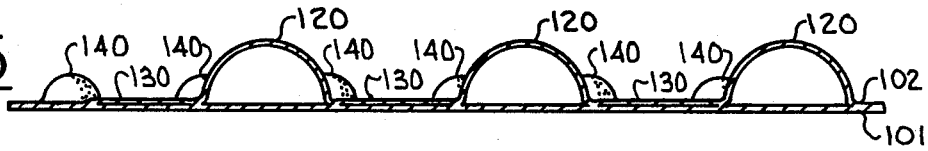

INFLATABLE PILLOW SUPPORT

BACKGROUND OF THE INVENTION

I. Field of the Invention

The present invention relates to inflatable body supports having a plurality of pockets which are alternately inflated and deflated to support adjacent sections of the human body. In particular, the present invention includes adaptations which are particularly suitable for coupling the apparatus to various systems of automotive vehicles.

II. Description of the Prior Art

It is well known to those who remain immobile for lengthy periods of time that the supporting sections of the body become uncomfortable and irritated after periods of only several hours. While bed-ridden hospital patients form the most severe example of immobility, this problem also faces drivers who must sit behind the wheel of an automobile or truck for several hours of driving without the opportunity to take breaks for the purpose of stimulating the circulation and for exercising the muscles which have supported the body.

It is also well known that the fatigue and discomfort which accompany long periods of immobility may contribute to automobile and truck accidents which are caused by the driver failing to maintain proper attention to his driving responsibilities. Therefore, while the present invention is designed primarily to aid in maintaining the comfort of a person who is required to be seated for long periods of time, such as in wheelchairs, it may also be useful for improving the comfort and safety record of long distance drivers.

The concept of pressure necrosis is well known in the prior art. Basically, the pressure exerted upon the muscle and skin surfaces which support the body weight for long periods of time causes a decrease in the circulation of blood in epidermal surfaces adjacent these areas. Certain smaller areas within these large pressure areas are more critical since the body bone structure is closer to the skin surface and excerts extra pressure thereupon, often causing the occurance of ulcers or bedsores near the sacrum of ischial tuberosities. Also, the movement of the pillow sections enhances air circulation between the pillow and the supported body sections, thereby cooling the body and inhibiting the onset of a rash.

The prior art contains many solutions to these problems. Nos, in U.S. Pat. No. 3,959,835, discloses the use of a plurality of air chambers, each interconnected with its neighbor through the use of a transversely extending hose having an inside diameter determined in order to control the rate of flow of the gas between adjacent chambers. Grant, in U.S. Pat. No. 3,199,124, discloses the use of an inflatable air mattress which includes a plurality of alternately inflatable air chambers, and also employs a plurality of smaller alternately inflatable chambers adjacent the feet of the reclining patient. Voelker, in U.S. Pat. No. 3,840,920, discloses the use of a non-resilient but flowable material and means for controlling the flowability of the material between compartments which comprise a mattress for pregnant mothers. Ducker, in U.S. Pat. No. 3,909,858, discloses a mattress having a plurality of alternately inflatable compartments which are separated by foam rubber cells.

Independently inflatable cushions have also been utilized in automotive seats. Vanderbilt, in U.S. Pat. No. 3,326,601, discloses the use of inflatable pockets arranged to form the back support for an automotive seat.

Morrell, in U.S. Pat. No. 2,867,732, discloses the use of an automotive seat cushion employing a plurality of separately inflatable tubes which are mutually coupled by a tube which communicates through a center groove in each of the inflatable tubes. Burgin, in U.S. Pat. No. 3,982,786 discloses a chair having a plurality of specially interconnected cushion elements. These cushion elements are connected such that when the occupant sits in the chair the fluid in certain ones of the inflatable pockets are forced into other selected ones of the inflatable pockets for adjusting to the contour of the body shape of the occupant.

Parker, in U.S. Pat. No. 3,394,415, discloses an inflatable bed mattress constructed of a plurality of elongated inflatable cells which are completely independent and separate from each other and which do not include a unitary top communicating surface. Castagna, in U.S. Pat. No. 3,595,223, discloses a reclining couch having a plurality of manifolds which in turn form another plurality of inflatable chambers. Spence, in U.S. Pat. No. 3,308,491, discloses a seat cushion formed of a stretchable impermiable membrane surrounding a core formed of a hypoallergenic, nonfriable and jelly-like substance for evenly distributing the weight of the occupant over the entire surface of the contacting area.

While the prior art illustrates various designs of cushions with inflatable cells, the prior art does not illustrate the use of elements which are specifically adapted for economical construction and use, and for elements which are specifically adapted for coupling to and use with various support systems within automotive vehicles.

Thus, a first object of the present invention is to adapt the pump for economical construction and reliable performance through the use of a solenoid actuator operably coupled to at least one pumping chamber.

Another object of the present invention is to construct the inflatable pillow support to include a plurality of nondeflatable cells which serve as a minimum or residual support independent of the inflation or deflation status of the remaining inflatable cells.

A still further object of the present invention is to incorporate the use of a heat exchanger which controls the temperature and heat content of the fluid under pressure within the inflatable cells of the cushion by removing or adding heat obtained from various support systems of an automobile such as the engine cooling system and the air conditioning system.

SUMMARY OF THE INVENTION

This invention relates to an alternating pressure support for the human body. The apparatus includes a flexible pillow having a plurality of fluid impervious pockets adapted to assume a substantially flat position when deflated and to support an adjacent section of the human body when inflated with fluid under pressure. These pockets are grouped into an operably coupled first set of pockets and an operably coupled second set of pockets, with the first set and the second set being interspersed among each other. Pumping means are provided which include at least one pumping chamber for receiving and then expelling the fluid under pressure, a solenoid means operably coupled to the pumping chamber for operably compressing and then expanding the pumping chamber, and energizing means for periodically energizing the solenoid means for pumping the fluid under pressure from the pumping chambers. Valve means are operably coupled between the pump means and the flexible pillow for alternately inflating and exhausting the fluid under pressure through the first pockets and the second pockets, thereby alternately supporting interspersed sections of the body adjacent the first and second sets of pockets.

BRIEF DESCRIPTION OF THE DRAWINGS

Other objects, features and advantages of the present invention will be apparent through a study of the written description and the drawings in which:

FIG. 1 illustrates a schematic electrical and mechanical diagram of an inflatable cushion system in accordance with the present invention.

FIG. 2 is a cross-section view of the inflatable cushion taken along section lines 2—2 as illustrated in FIG. 1.

FIG. 3 illustrates a top perspective view of a second preferred embodiment of an inflatable cushion which employs a plurality of non-deflating cells which provide a residual support independent of the level of inflation of the other cells.

FIG. 4 is a cross-section view of the second preferred embodiment of the inflatable pillow taken along section lines 4—4 in FIG. 3.

FIG. 5 is a cross-section view of the second preferred embodiment of the inflatable pillow taken along section lines 5—5 in FIG. 3.

DETAILED DESCRIPTION OF THE PREFERRED EMBODIMENT

Figure 6:
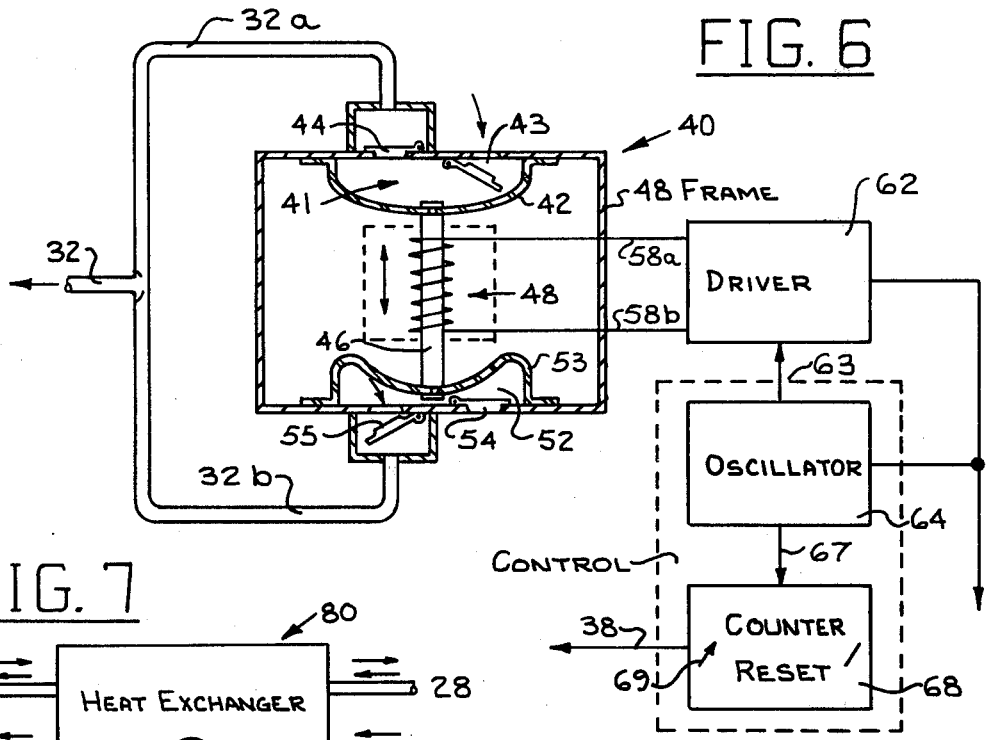
FIG. 6 illustrates a mechanical and electrical schematic diagram of a first preferred embodiment of the pump used to supply the fluid under pressure to the inflatable pillow.

A first preferred embodiment of the alternating pressure support for the human body is illustrated generally in FIGS. 1 and 2. The apparatus includes a first preferred embodiment of a flexible pillow 10 which is formed from two juxtaposed sheets of fluid-impervious materials 14 and 16. These adjacent sheets of flexible material are coupled along a generally serpantine seal 18 for forming a plurality of pockets 20 which are adapted to assume a substantially flat position when deflated, but to support an adjacent section of the human body when inflated with a pressurized fluid.

As illustrated in FIGS. 1 and 2, the first preferred embodiment of the flexible pillow 10 includes a plurality of interleaved elongated pockets 20 which are formed between a lower sheet 11 and an upper sheet 12 of a fluid impervious material juxtaposed therewith. The pockets 20 are adjacent to each other for the entire length except for the ends thereof which couple with manifold 22 positioned along longitudinal end thereof. A first set of inflatable pockets **20*a* is illustrated as being deflated, while a second set 20*b* of pockets is illustrated as being inflated for supporting an adjacent section of the human body seated thereupon. Other functionally equivalent designs may be employed for interleaving or grouping the sets of pockets 20 to form the same function. The lower sheet 11 in the first preferred embodiment of the inflatable pillows 10 may either be formed to be flat or to deform downwardly along the pockets when inflated. It is envisioned that the upper sheet 12 will be vacuum formed so as to lie substantially flat when deflated but not greatly reduce the effective width of the pockets 20** when inflated.

A manifold **22*a* which operably couples the first group of inflatable pockets 22*a* is coupled to a first tube 26 which in turn is coupled to a valve 30. In a similar fashion a second manifold 22*b* which operably couples the second set of inflatable pockets 20*b* is operably coupled through a tube 28 with the valve 30. An input of the valve 30 is coupled through a tube 32 to the output of a pump 40 for receiving a flow of pressurized fluid therefrom. The valve 30 is designed to operably divert the flow of this pressurized fluid between either the first tube 26 or the second tube 28 for alternately inflating and deflating the inflatable pockets 20*a* and 20*b*. The valve 30 is generally designed to simultaneously exhaust the pressurized fluid from one set of pockets while inflating the other set of pockets. The rate of exhaust of the fluid from the pockets 20 is independently controlled through a first adjustment screw 34 paired with the first tube 26 and a second adjustment screw 36 paired with the second tube 28. The valve 30 is electrically switched between two functional positions responsive to an electrical signal emitted by control circuitry 60 which is coupled to the valve 30 through the electrical circuit line 38. The valve 30 may also be regulated to cause both sets of inflatable pockets 20 within the inflatable pillow 20** to be simultaneously inflated for a period of time during the inflation - deflation cycle.

As illustrated in FIG. 6, the pump 40 includes a frame 48 defining a first pump chamber 41 having a flexible and movable diaphragm 42, an inlet valve 43, and an exhaust valve 44 which couples to a first branch tube **32*a* which in turn couples to the main exhaust tube 32. In a similar manner a second pump chamber 52 is defined by a diaphragm 53, an inlet valve 54, and an exhaust valve 55 which opens into a branch tube 32*b* which is coupled to the exhaust tubing 32. A central section of the diaphragms 42 and 53 are operably coupled by a solenoid shaft 46 having a solenoid shaft 46 having a solenoid coil 48 operably coupled therearound. As the solenoid coil 48 is energized, the solenoid shaft 46 is reciprocated by electromagnetic forces downwardly along its longitudinal axis to operably compress the diaphragm 53, thereby reducing the effective volume of the second pumping chamber 42. The fluid or air contained within the second pumping chamber 52 will be forced through the exhaust valve 55, through the branch tubing 32*b* and into the exhaust tube 32 for being transmitted to the valve 30. Simultaneously, the volume defined by the first pumping chamber 41 will be increased thereby ingesting fluid or air through the inlet valve 43**.

As the polarity of the voltage coupled to the solenoid coil 48 is reversed, the solenoid shaft 46 will be driven in the reverse direction for exhausting the fluid or air from within the first pumping chamber 41 and ingesting the fluid or air into the second pumping chamber 52. In this manner the solenoid shaft 46 will be electrically driven in a reciprocal motion to pressurize the fluid transmitted through the exhaust tubing 32 coupled thereto.

An electrical signal is coupled to the solenoid coil 48 through the circuit lines 58*a* and 58*b* from an electrical amplifier or driver 62. The driver 62 is controlled through the circuit line 63 for receiving an oscillator signal from the oscillator 64. The oscillator 64 generally comprises an AC signal generator which operates at approximately 10 to 100 Hertz. A second output of the oscillator 64 is coupled through a circuit line 67 to a counter 68. The counter 68 counts the number of oscillator pulses or periods at its input and accumulates the number of these input signal periods until that number coincides with a preset counter limit 69. Then the counter 68 generates a switching signal coupled through the circuit line 38 to switch the valve 30. In this manner the operation of the electric valve 30 is controlled responsive to the number of operative cycles of the pump 40. Other functionally equivalent timing means, such as an IC 555 or equivalent, may be substituted for the counter 68 in order to generate the switching signal along the circuit line 38 to periodically change the operative position of the valve 30 for inflating and deflating the various pairs of inflatable pockets 20 within the flexible pillow 10.

Figure 7:
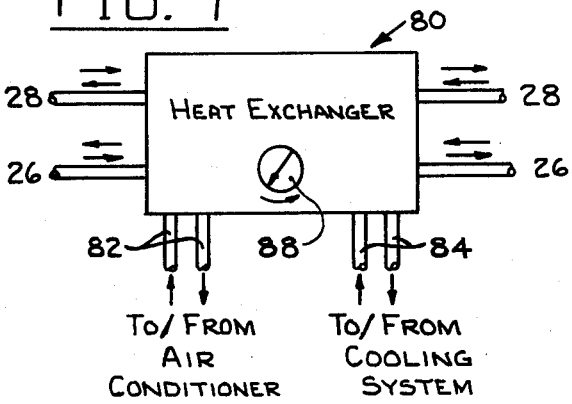
FIG. 7 illustrates a multi-function heat exchanger for being inserted between the inflatable pillow and the valve as illustrated in FIG. 1.

With reference to FIGS. 7 and 1, it is also envisioned that an accessory heat exchanger, shown generally as 80, may be interposed in the first tube 26 and the second tube 28 between the exhaust valve 30 and the flexible pillow 10. The heat exchanger 80 would be operably coupled through circulator lines 82 to the air conditioning compressor of an automobile. In this manner the compressed freon can be transmitted through the circulator lines 82 and expanded in order to remove ambient energy from the fluid or air under pressure being transmitted through the tubes 26 and 28 into the pockets 20 of the flexible pillow 10. Thus, on a warm day the air flowing into the inflatable pillow 10 may be cooled in order to reduce the temperature of the body sections resting thereupon. It is also envisioned that an internal compartment 81 may be provided within the heat exchange 80 for receiving a coolant, such as dry ice or equivalent, therein for absorbing ambient heat from the fluid being transmitted through the tubes 26 and 28.

In a similar manner circulator lines 84 of the heat exchanger 80 may be coupled to the cooling system or radiator of the automobile for receiving hot water or cooling fluid therefrom. The ambient heat from the cooling fluid from the cooling system of the automobile may be extracted and transferred to increase the temperature of the fluid or air under pressure transmitted through the tubes 26 and 28, thereby increasing the temperature of the adjacent body parts supported by the inflatable pillow 10 during cold weather. A heat exchanger control valve 88 allows the operator to manually select from either the cooling function, the heating function, or a disengage function for manually controlling the effective temperature of the fluid under pressure within the pockets 20 in the flexible pillow 10.

A second preferred embodiment of the flexible pillow is shown generally as 100 in FIGS. 3, 4 and 5. This second flexible pillow 100 includes a substantially flat lower sheet 101 and contoured second sheet 102 juxtaposed therewith. The second sheet 102 is coupled to the lower sheet 101 along a generally complex serpantine pattern for defining therebetween a plurality of inflatable pockets 120 and 130. Typically these pockets 120 and 130 have a generally undulating diameter which periodically varies from thin to wide along the longitudinal length of each of the various pocket elements. The sets of pockets 120 and 130 are arranged to be interleaved for alternately supporting adjacent sections of the human body resting thereupon.

Furthermore, the narrow sections of the pockets 120 and 130 are oriented in registration such that an additional set of non-deflating third pockets 140 may be formed between the upper sheet 102 and the lower sheet 101 of the flexible pillow 110. These additional third pockets 130 are generally of smaller elevation when compared to the maximum elevation or extension of the larger pockets 120 and 130. The third pockets 130 are included to provide a minimum level of support for the sections of the human body resting thereupon when either/or both of the sets of pockets 120 and 130 are not inflated. It should be noted at this point that the scale and dimensions of the second preferred embodiment 100 of the flexible pillow have been distorted in order to simplify the pictorial representation of the spacings between the third pockets 130 and the inflatable and deflatable pockets 120 and 130.

With reference to FIG. 1, it is also envisioned that the present system may be adapted for use with trucks or other large vehicles which have a readily available source of compressed air or other similar fluid. This system may be modified by eliminating the pump 40 and instead coupling the source of pressurized air through a pressure regulator into the tubing 32 coupled to the input of the valve 30. In this manner the high pressure (approximately 120 psi) air produced by the vehicle will be reduced to approximately 3 to 5 psi through the regulator for inflating the pockets 20 within the flexible pillow 10.

Figure 8:
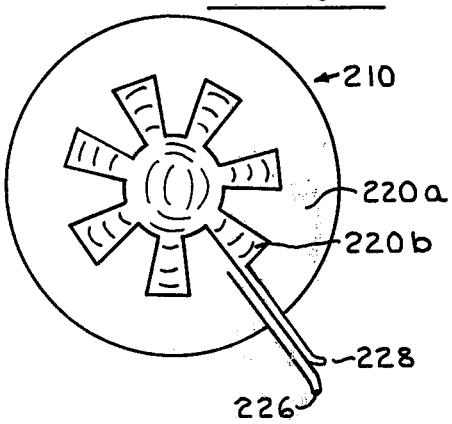
FIG. 8 illustrates a top view of a third preferred embodiment of the inflatable pillow in accordance with the present invention.

A third preferred embodiment of the flexible pillow is shown generally as 210 in FIG. 8. This embodiment is similar to the second preferred embodiment 100 except that one set of inflatable pockets 220*b* radiate outwardly from the center of the pillow 210, while another set of inflatable pockets 220*a* protrude radially inward from the circumference of the pillow.

Figure 9:
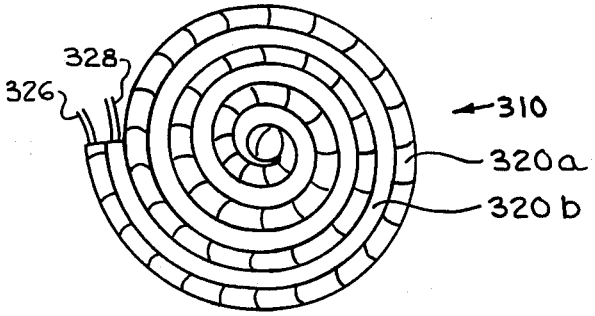
FIG. 9 illustrates a top view of a fourth preferred embodiment of the inflatable pillow in accordance with the present invention.

A fourth preferred embodiment of the flexible pillow is shown generally as 310 in FIG. 9. This embodiment is similar to the second preferred embodiment 100 except that one elongated inflatable pocket 320*a* and another elongated inflatable pocket 320*b*, both of which may be subdivided into smaller subpockets, are juxtaposed longitudinally and wound radially to form a radial pillow shape. It should be noted that both the third embodiment 210 and the fourth embodiment 310 have been pictorially simplified for the sake of clarity, and both may include additional inflatable pockets or additional permanently inflated pockets.

The operation of the alternating pressure support pillow will now be described with reference to FIG. 1. The operator will first be seated upon the flexible pillow 10 which may be arranged to provide seating or a combination seating and backrest for the occupant. The operator will then actuate the control circuitry 60 for enabling the oscilator 64 which actuates the drivers 62 for reciprocating the solenoid shaft 46. In this manner the pump 40 will pressurize the fluid flowing through the transmission tubes 32 flowing into the valve 30. The control circuitry 60 will also actuate the valve 30 to engage and transmit the pressurized fluid or air into either the first tube 26 or the second tube 28 for inflating the respective sets of pockets 20 coupled thereto. Simultaneously, the pressurized fluid will be exhausted at a controlled rate from the other one of the sets of pockets 20 through the valve 30. After a predetermined period of time, the control circuitry 60 will change the operative position of the valve 30 for pressurizing the formerly depressurized set of pockets while exhausting the air from the formerly pressurized pockets 20. The rate of exhaust is controllable by the respective screw adjustment 34 and 36 in the valve 30. In this manner the sections of the human body being supported by the flexible pillow 10 will be alternately supported and then not supported by the operation of the pockets 20 adjacent thereto as the first set of pockets 20*a* and the second set of pockets 20*b* are alternately inflated and deflated by the operation of the valve 30.

The period required for a complete cycle of inflation deflation may be adjusted to the requirements of the particular occupant of the flexible pillow 10. Also, the rate of exhaust of the pressurized fluid from the deflating pockets 20 may be adjusted to provide an additional period when both sets of pockets are simultaneously inflated during the inflate-deflate cycle. With regard to the second preferred embodiment 100 of the flexible pillow 100 as shown in FIG. 3, the third pockets 130 will provide additional support even while the other two sets of pockets 120 and 130 are not inflated, or during the periods of time during which these pockets are transitioning between the inflated and deflated states.

Thus, a first preferred embodiment of the system as well as a second preferred embodiment of the inflatable pillow have been described as an example of the invention as claimed. However, the present invention should not be limited in its application to the details and constructions illustrated in the accompanying drawings or the specification, since this invention may be practiced or constructed in a variety of other different embodiments. Also, it must be understood that the terminology and descriptions employed herein are used solely for the purpose of describing the general process and the preferred embodiment, and therefore should not be construed as limitations on the operability of the invention.

We claim:

1. An alternating pressure support for the human body, said apparatus comprising in combination:

a flexible pillow having a plurality of fluid-impervious pockets adapted to assume a substantially flat position when deflated and to support an adjacent section of the human body when inflated with a fluid under pressure, with said pockets interspersed and grouped into an operably coupled first set of pockets and an operably coupled second set of pockets;

pumps means including, (a) an opposing pair of pumping chambers each for periodically receiving and then expelling said fluid under pressure, (b) electrical means operably coupled between said pumping chambers for alternately compressing one of said pumping chambers while expanding the other one of said pumping chambers, thereby alternately pumping said fluid under pressure from each of said pumping chambers; and valve means operably coupled between said pump means and said flexible pillow for alternately inflating and exhausting said fluid under pressure through said first pockets and said second pockets, thereby alternately supporting interspersed sections of the body adjacent said first and said second sets of pockets.

2. The alternating pressure support apparatus as described in claim 1 further including timer means coupled to said valve means for controlling the flow of said fluid under pressure into said first set of pockets and into said second set of pockets, with said timer means having a manually variable actuation period.

3. The alternating pressure support apparatus as described in claim 1 wherein said electrical means includes a central shaft defining an axis of reciprocal motion therethrough, with one of said opposing pumping chambers operably coupled to a first end of said central shaft and with the other one of said opposing pumping chambers operably coupled to a second end of said central shaft, whereby the reciprocal motion of said central shaft alternately pumps said fluid under pressure from said opposing pumping chambers.

4. The alternating pressure support apparatus as described in claim 2 wherein said energizing means comprises oscillator means operating in the range of 10 Hz to 100 Hz for alternately supplying with reverse polarity the electrical energy for actuating said electrical means.

5. The alternating pressure support apparatus as described in claim 1 wherein said valve means includes means for maintaining said fluid under at least partial pressure within both said first set of pockets and said second set of pockets for a portion of the inflation-exhaust cycle.

6. The alternating pressure support apparatus as described in claim 5 further including exhaust means coupled to said valve means for controlling the rate of exhaust of said fluid from said flexible pillow.

7. The alternating pressure support apparatus as described in claim 1 wherein said flexible pillow includes a substantially planar lower surface and a flexible upper surface coupled thereto so as to form said first set of pockets and said second set of pockets.

8. The alternating pressure support apparatus as described in claim 1 wherein said flexible pillow further includes therein a third set of fluid impervious pockets interspersed among said first set of pockets and said second set of pockets, with said third set of pockets inflated with a fluid under pressure for providing a residual supporting surface for the body section adjacent thereto.

9. The alternating pressure support apparatus as described in claim 8 wherein the height of said third set of pockets is approximately one-half the height of said first set of pockets and said second set of pockets when fully inflated.

10. The alternating pressure support apparatus as described in claim 1 further including heat exchanger means operably coupled between said valve means and said flexible pillow for removing thermal energy from said fluid under pressure flowing therebetween, with said heat exchanger being operably coupled to an air conditioning system of an automotive vehicle for transferring said thermal energy thereto.

11. The alternating pressure support apparatus as described in claim 10 wherein said heat exchanger means is operably coupled to the cooling system of an automobile for receiving hot engine coolant therefrom for controllably heating said fluid under pressure.

12. An alternating pressure pillow for supporting the human body and of the type for being coupled to a source of high-pressure air from an automotive vehicle, said apparatus comprising in combination;

a flexible pillow having a plurality of air-impervious pockets therein adapted to assume a substantially flat position when deflated and to support an adjacent section of the human body when inflated with air under pressure, with said pockets interspersed and grouped into an operably coupled first set of pockets and an operably coupled second set of pockets;

regulator means coupled at an input thereof to the source of pressurized air from the automotive vehicle, said regulator means for reducing the pressure of the air at an output thereof; and valve means operatively coupled between said output of said regulator means and said flexible pillow, said valve means for inflating said first set of pockets with said air of reduced pressure while exhausting the pressurized air from said first set of pockets and then inflating said second set of pockets with said air of reduced pressure while exhausting the pressurized air from said second set of pockets.

13. The apparatus as described in claim 12 wherein said flexible pillow includes therein a third set of fluid-impervious pockets interspersed among said first set of pockets and said second set of pockets, with said third set of pockets being inflated with a fluid under pressure for providing a residual supporting surface for the body section adjacent thereto.

14. The apparatus as described in claim 12 further including heat exchanger means operatively coupled between said valve means and said flexible pillow for controlling the temperature of the air flowing under pressure therethrough.

15. The apparatus as described in claim 12 wherein said valve means includes means for maintaining said air under reduced pressure within both said first set of pockets and said second set of pockets simultaneously for at least a portion of the inflation-exhaust cycle.

* * * * *